US008410442B2

(12) United States Patent
Hankel et al.

(10) Patent No.: US 8,410,442 B2
(45) Date of Patent: Apr. 2, 2013

(54) DETECTOR TUBE STACK WITH INTEGRATED ELECTRON SCRUB SYSTEM AND METHOD OF MANUFACTURING THE SAME

(76) Inventors: Nathaniel S. Hankel, San Diego, CA (US); Ken Jamison, Boerne, TX (US)

( * ) Notice: Subject to any disclaimer, the term of this patent is extended or adjusted under 35 U.S.C. 154(b) by 0 days.

(21) Appl. No.: 13/253,930

(22) Filed: Oct. 5, 2011

(65) Prior Publication Data

US 2012/0175519 A1 Jul. 12, 2012

Related U.S. Application Data

(60) Provisional application No. 61/389,807, filed on Oct. 5, 2010.

(51) Int. Cl.
*H01J 43/00* (2006.01)

(52) U.S. Cl. ..... 250/336.1; 250/214 VT

(58) Field of Classification Search ..... 250/336.1
See application file for complete search history.

(56) References Cited

U.S. PATENT DOCUMENTS

| | | | | |
|---|---|---|---|---|
| 4,054,405 | A | 10/1977 | Facey et al. | |
| 4,437,844 | A | 3/1984 | Petito et al. | |
| 5,408,087 | A * | 4/1995 | Thomas | 250/214 VT |
| 5,783,900 | A * | 7/1998 | Humphries et al. | 313/420 |
| 6,049,168 | A * | 4/2000 | Iosue et al. | 313/542 |
| 6,198,090 | B1 * | 3/2001 | Iosue | 250/214 VT |
| 6,239,549 | B1 | 5/2001 | Laprade | |
| 6,320,180 | B1 * | 11/2001 | Estrera et al. | 250/214 VT |
| 6,338,663 | B1 * | 1/2002 | Watkins et al. | 445/60 |
| 6,492,657 | B1 | 12/2002 | Burlefinger et al. | |
| 6,500,040 | B2 | 12/2002 | Browning et al. | |
| 6,657,385 | B2 | 12/2003 | Tomasetti et al. | |
| 6,908,355 | B2 | 6/2005 | Habib et al. | |
| 6,958,474 | B2 | 10/2005 | Laprade et al. | |
| 7,026,177 | B2 | 4/2006 | Laprade | |
| 7,038,223 | B2 | 5/2006 | Starcher | |
| 7,081,618 | B2 | 7/2006 | Laprade | |
| 7,555,185 | B2 | 6/2009 | Laprade et al. | |
| 7,768,267 | B2 | 8/2010 | Knott et al. | |
| 2001/0009060 | A1 * | 7/2001 | Browning et al. | 29/458 |
| 2004/0183028 | A1 | 9/2004 | Laprade | |
| 2010/0090098 | A1 | 4/2010 | Laprade | |

OTHER PUBLICATIONS

Photonis, Electrogen Electron Generator Arrays Data Sheet, Oct. 30, 2009, 2 pgs (Available at www.photonis.com).

* cited by examiner

*Primary Examiner* — Marcus Taningco
(74) *Attorney, Agent, or Firm* — Kammer Browning PLLC

(57) ABSTRACT

A novel detector tube structure (such as for a neutron detection tube) and method of manufacture are described. The novel manufacturing process carries out the electron scrubbing of the detection surface/material after the container enclosure has already been sealed. In this manner, much of the complex manufacturing equipment typically associated with such detection tubes can be eliminated and large numbers of detectors may be manufactured at the same time. The present invention therefore involves a novel detector tube structure and a new method of manufacture for the same.

2 Claims, 6 Drawing Sheets

(A - A′)

DETECTOR TUBE STACK WITH INTEGRATED ELECTRON SCRUB SYSTEM AND METHOD OF MANUFACTURING THE SAME

CROSS REFERENCES TO RELATED APPLICATIONS

This application claims the benefit under Title 35 United States Code §119(e) of U.S. Provisional Patent Application Ser. No. 61/389,807; filed Oct. 5, 2010, the full disclosure of which is incorporated herein by reference.

BACKGROUND OF THE INVENTION

1. Field of the Invention

The present invention relates generally to devices for the detection of particles and electromagnetic (EM) radiation and to methods for the manufacture of such devices. The present invention relates more specifically to methods for the more efficient manufacture of detection tubes using detection materials that require electron scrubbing to form an optimal detection device. The system provides electron scrubbing in a generally closed environment as part of the manufacturing process.

2. Description of the Related Art

Various types of particle and EM radiation detectors (such as neutron detectors) depend upon the use of plates or surfaces of materials sensitive to the particles or radiation to be detected. Making such detectors operate in an optimal manner typically means manufacturing the material plate or surface to a very high level of uniformity and purity. The removal of surface contaminants becomes an important part of the manufacturing process. This process for removing contaminants from the sensitive detection surfaces and plates is often carried out using electron scrub guns. Such scrub devices excite the material to the point where contaminants and impurities are displaced from the surface and drawn away to be removed from the detector or to be held in a non-interfering position within the detector.

The typical contaminant removal process is a scrub then seal process where the scrubbing is carried out before or during a vacuum process and then the chamber within which the detector material is positioned is closed and sealed. This can be an expensive and complex manufacturing process often requiring highly sophisticated vacuum and exhaust chambers. Frequently the manufacturing process is slow with the scrub then seal steps operating on only one or a very few detector tube assemblies at a time.

Traditional detectors that require electron scrubbing would be typically manufactured in an open configuration before processing and sealing. This manufacturing configuration, primarily required by the manner of electron scrubbing, involves a large open area that exposes the entire set of active detector components. This results in a much greater threat to the quality of the detector derived from the manufacturing process whereby exposure of the detector internal components to particles generated during processing occurs. Detectors are generally high voltage devices with close parts spacing, and therefore the presence of particulate contamination results in a higher frequency of static discharge and high voltage arcing during operation.

Typical prior art electron sources (electron scrub guns) must be placed several inches away from the surfaces they are intended to activate or clean. This is due to the general emission shape of the electron stream which may be characterized as emitting from a point source or small area. The further the separation (throw distance) between the electron source and the surface to be cleaned, the wider the spread of the electron stream. To create a relatively uniform stream of electrons, the traditional electron source must be positioned further back from the detector plates being scrubbed to impart a uniform flux to the edges of the detector relative to the center of the detector. In many cases, this effect under-processes the detector peripheral areas while over-processing the detectors central area where the electron flux is greater. This uneven scrub often leads to detector image defects, such as darker, less responsive outer regions, if the overall detector is not sufficiently activated or scrubbed.

In contrast to electron scrub guns, electron emitting plates produce a much more uniform stream of electrons, which can be used to more uniformly scrub, or activate a detector's surface. It is also possible to position such an electron source closer to the detector surfaces that are being scrubbed during the detector activation and manufacturing process. In other words, the use of electron generating plates reduces the need to create separation between the emitter plate and the detector surface being activated or cleaned. The work done by an electron scrub source is a function of its flux (quantity of emitted electrons) and voltage separation between the electron generating plate and the surface to be cleaned or activated. The emission flux of an electron generating plate (or a stack of generating plates) used to clean surfaces in a vacuum is adjustable by varying the applied voltage separation between the generating plate and activation surface, as well as varying the number of electron generating plates placed in a series configuration in proximity to the detector plate or plates.

It would be desirable, therefore, to have a detector tube device, and a method for manufacturing the same, that were capable of utilizing electron generating plates as the electron scrub source so as to improve the manufacturing process and reduce the incidence of particle contaminants within the detector, and to further reduce variations in the quality and character of the detector plate surface after scrubbing. It would be helpful to configure the manufacturing process for a detector tube stack into a smaller space that requires fewer ancillary mechanical parts and hardware to draw a vacuum and then perform a sealing operation with the vacuum or near vacuum in place. It would be desirable to eliminate as many sources of significant particle generating hardware from the overall manufacturing system. It would be desirable to position and place the electron scrub source in close proximity to the detector plate(s) to be scrubbed, thereby again minimizing the space required for the manufacturing process and the number and size of the components required.

SUMMARY OF THE INVENTION

The present invention provides a new detector tube structure and manufacturing process that carries out electron scrubbing after the detector enclosure has already been closed and at least partially sealed. In this manner, much of the complex manufacturing equipment can be eliminated and large numbers of detectors may be manufactured at the same time. The present invention therefore involves a novel detector tube structure and a new method of manufacture for the same.

The application of electron generating plates to the closed detector manufacturing process reduces the size and complexity of the necessary vacuum system by eliminating many of the manipulation hardware components previously utilized to perform a seal in a vacuum. This eliminates many significant particle generating components from the overall vacuum process. The overall space within which the manufacturing process occurs is reduced due to the close proximity between the electron generating plates and the detector surfaces being activated and cleaned. This manufacturing volume reduction reduces systems that required separation distances between the scrub source and the scrub surface of several inches to significantly less than 1.0 inches and potentially down to under 0.1 inches. The reduction of the manufacturing process to a more compact configuration allows for higher performance operation in the detector and vacuum processing and produces a higher quality detector. The detectors produced by the systems and methods of the present invention are less likely to fail for electrostatic defects or for image or response non-uniformity. A detector with a greater operation lifetime is also produced as the vacuum levels of the lower volume vacuum systems consistently pump down to lower base vacuum pressures, thus producing detectors with lower levels of contaminating internal gas molecules, which can over time degrade the detector performance.

The present invention provides a novel structure that allows for the manufacturing process to place the electron scrub source in close proximity to the detector surfaces. This novel structure enables the manufacturing process to present a mechanically assembled detector to the vacuum processing steps. This is accomplished by placing the electron generating plate within the housing of the detector as opposed to external to the detector structure during the manufacturing process. This novel structure therefore permits a novel method of manufacture that achieves the benefits described above.

DETAILED DESCRIPTION OF THE PREFERRED EMBODIMENTS

Figure 1A:
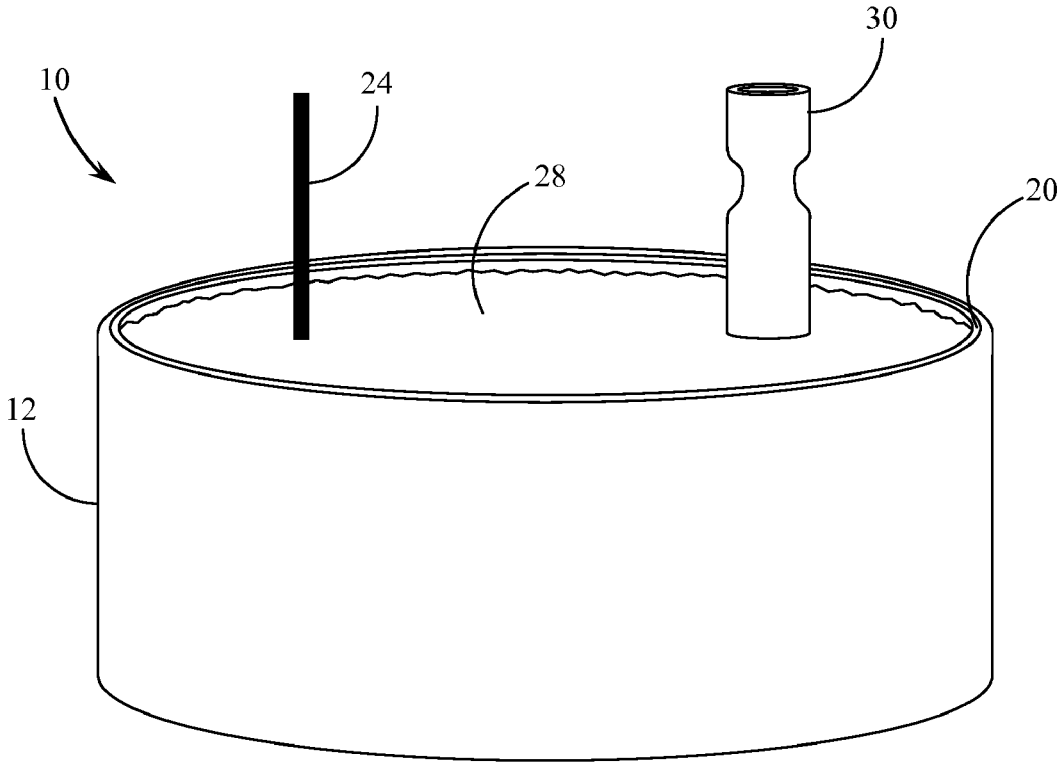
FIG. 1A is a perspective view of the detector tube system of the present invention shown fully assembled.

Reference is made first to FIG. 1A which is a perspective view of the detector tube system of the present invention shown fully assembled with the rear face of the tube positioned upright towards the top of the page and the front face of the tube hidden from view. Detector tube system 10 of the present invention, when fully assembled, is shown to be constructed from container body 12 that is welded to a rear end cap (not seen beneath the potting material) at rear end cap weld 20. Electrical feed through conductors 24 are shown to extend through potting material 28. Exhaust port 30 (to be connected to a vacuum source) is also shown extending through potting material 28 and is designed to be pinched off during the manufacturing process.

Figure 1B:
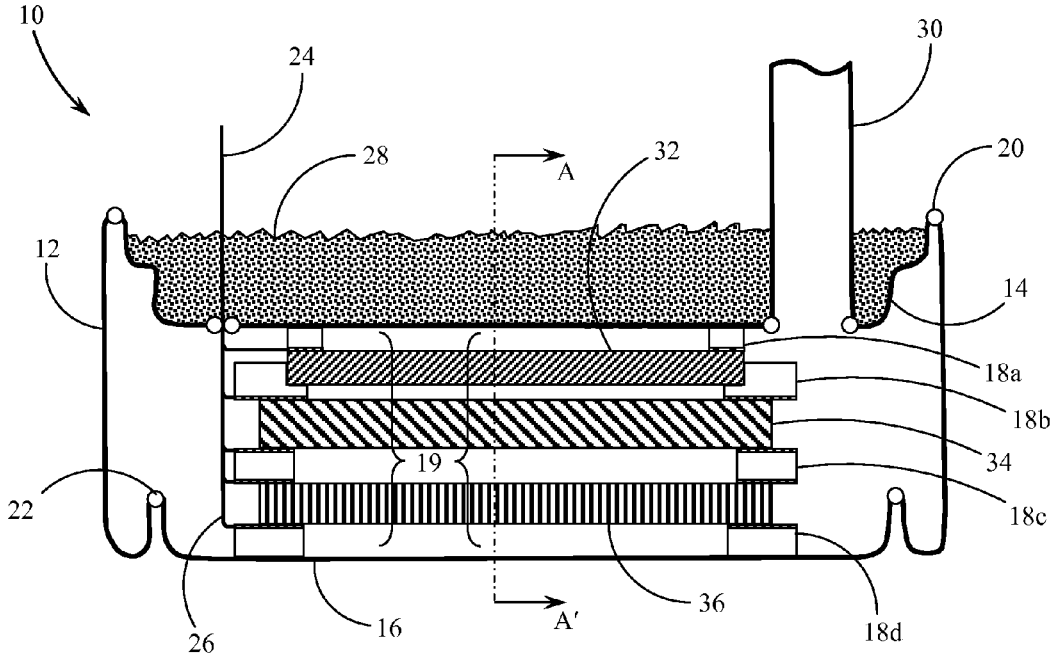
FIG. 1B is a detailed cross-sectional view of the stack structure of the detector tube system of the present invention.

Reference is next made to FIG. 1B which shows a cross-sectional view of the detector tube stack 10 of the present invention. The assembly comprises a container body 12 which holds and positions a number of plates 32, 34, and 36, in a stacked configuration as shown. Ceramic spacers/insulators 18*a*-18*d* provide substrates for a plurality of electrical connections 26. A formed end cap 16 is structured on the front of the container body 12, as well as a second formed end cap 14 on the rear of the container body 12. Appropriate welds 20 & 22 are positioned and made as indicated.

Electrical feed through conductors 24 (five in the preferred embodiment) are positioned and terminate in electrical connections 26 (again five in the preferred embodiment) as shown. An exhaust port 30 is placed and positioned as shown and is pinched off during the manufacturing process (as described in more detail below). A quantity of potting 28 is positioned within the formed end cap (rear) 14 of the container body 12. The exhaust port 30 and electrical feed through connections 24 extend through the potting material 28.

Figure 2:
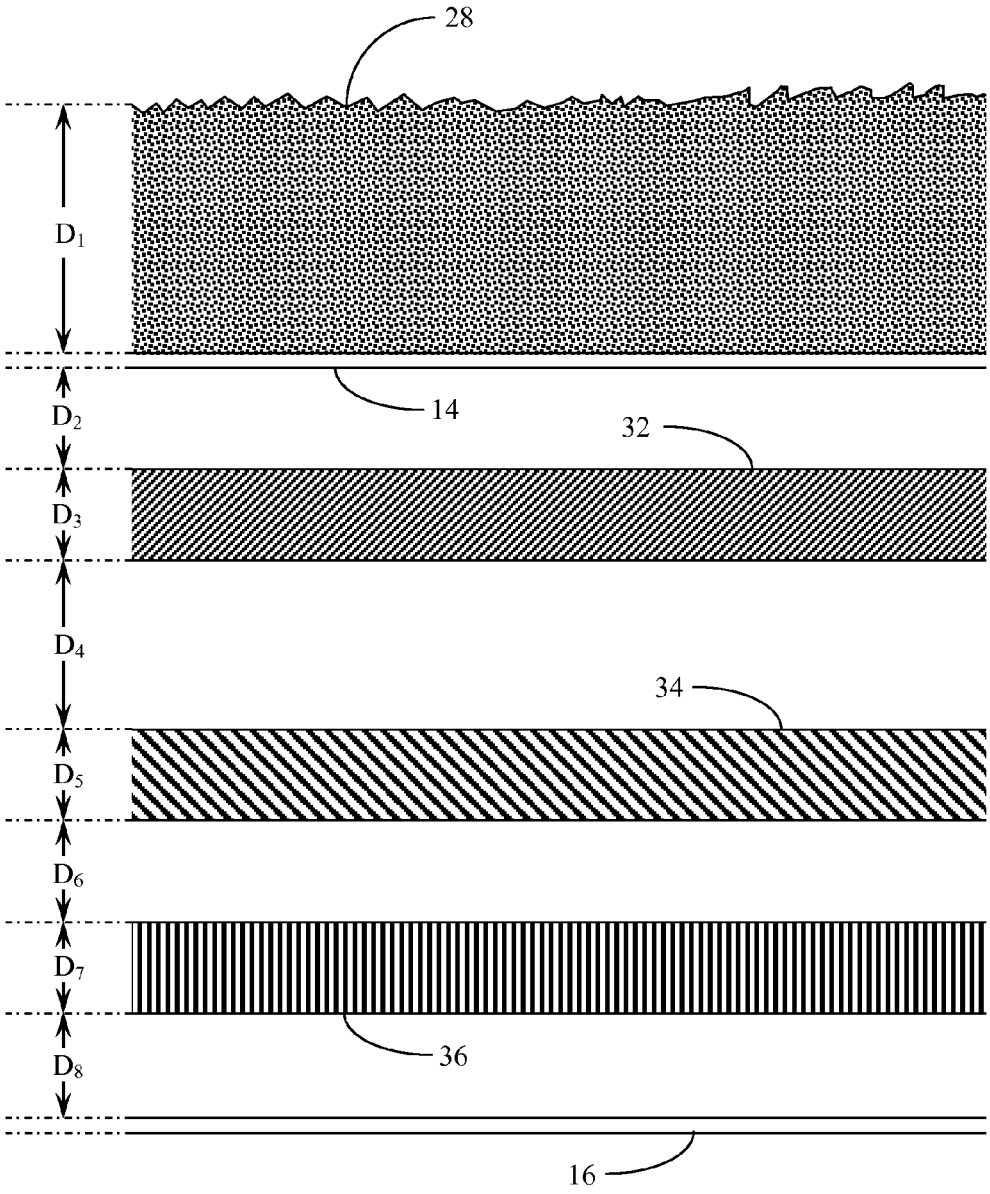
FIG. 2 is a detailed cross-sectional view of the plate stack of the present invention taken along section line A-A' in FIG. 1B.

FIG. 2 is a detailed cross-sectional view of the stack configuration shown generally in FIG. 1B. The potting material 28 of thickness is shown at the top of this cross-section view where it is supported by the formed end cap (rear) 14 of the container body 12. A collector plate 32 is positioned within the container body 12 using the spacers and insulator substrates 18 as described above. The collector plate 32, having a thickness, is positioned in spaced relationship from formed end cap (rear) 14, a distance, and from detection plate 34 (neutron sensitive material in the example shown) a distance, positioned within the center of the container body 12. Detection plate 34, having a thickness, is positioned in spaced relationship from electron generating plate 36 a distance of. The electron generating plate 36, having a thickness, is positioned immediately inside the formed end cap (front) 16 of the container body 12 separated by a distance.

The electron emissions from the electron generating plate 36 bombard the neutron micro channel plate (MCP) 34 during the scrubbing process. The process is proximity focused rather than beam focused as in the prior art. The bias voltage across the neutron MCP creates a cascade typical of normal MCP operation. The current (electron flow) is collected by the anode (collector) plate 32.

The components described above are mechanically located and fixed in position by the series of ceramic insulators and conductive contact surfaces as required. All of these components are sealed inside of the metal container that provides for a hermetic ultra high vacuum (UHV) environment for the device to function. As shown, the container includes electrical feed through connections, a pinch off pumping port, and a flashable getter.

Referencing back to FIG. 1B, the various plates, spacers, and electrical connections associated with the detector tube stack are characterized according to the normal functionality associated with each of the individual plates and layers. As shown in FIG. 1B, various electrical contacts are provided on the appropriate surfaces of the spacers to which electrical conductors may be connected to provide the necessary voltages for operation of the electron source during the manufacturing process, as well as the operation (signal detection) off of the detector plate after the detector tube stack manufacturing process is complete. These electrical connections may vary according to the specific construction of both the electron generating source (i.e., the number of electron generating plates in the component) as well as the particular arrangement of the spacers and the required electrical contacts. The electrical conductor representation shown in FIG. 1B and further in FIG. 3 (described below) are merely representative of a number of possible structures for making electrical connection to the internal components of the closed detector tube stack. Five such contacts are specified in the preferred embodiment as providing two contacts to the electron generating plate, two contacts to the detector plate, and a single contact to the collector plate. In addition, the metal can enclosure may be held at a set electrical potential.

Figure 3:
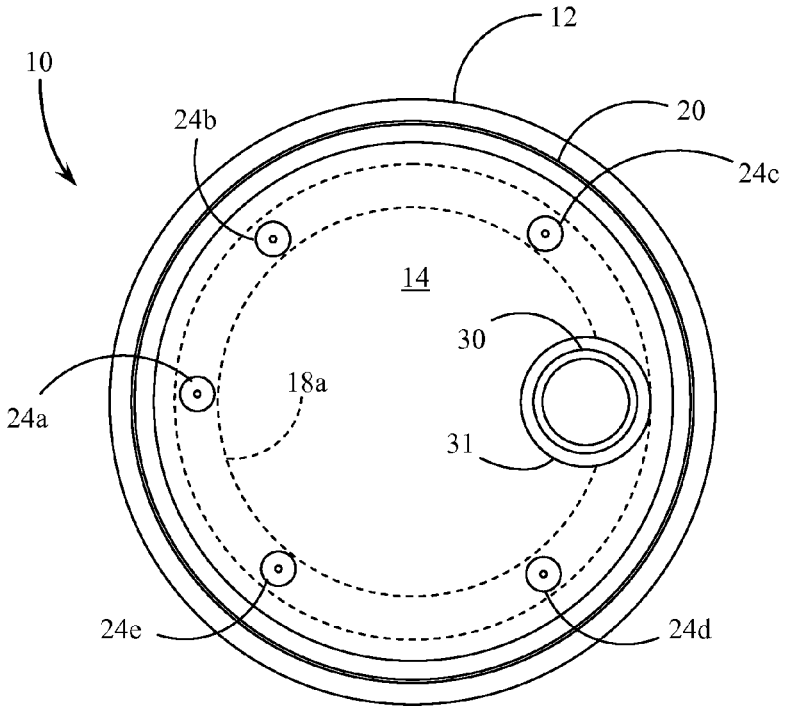
FIG. 3 is a top plan view of the detector tube system of the present invention shown with the potting removed.

FIG. 3 is a top plan view of the detector tube system of the present invention shown with the potting material removed for clarity. In this view, detector tube system 10 is again shown to be constructed primarily of container body 12 on top of which is positioned formed end cap (rear) 14. A representative ceramic spacer 18*a* is shown in dashed outline form in this view for purposes of identifying the alignment of one or more electrical feed through conductors 24*a*-24*c*. Rear end cap weld 20 is shown as the seam between container body 12 and formed end cap rear) 14. In addition, exhaust port 30 is shown as a cylindrical tube extending through formed end cap (rear) 14 and welded to the same at exhaust port weld 31. Electrical feed through conductors 24*a*-24*c* (five shown in this particular embodiment) are sealed against apertures formed in formed end cap (rear) 14 in the manner shown and are further sealed by the use of the potting material (not shown) as described above.

Figure 4:
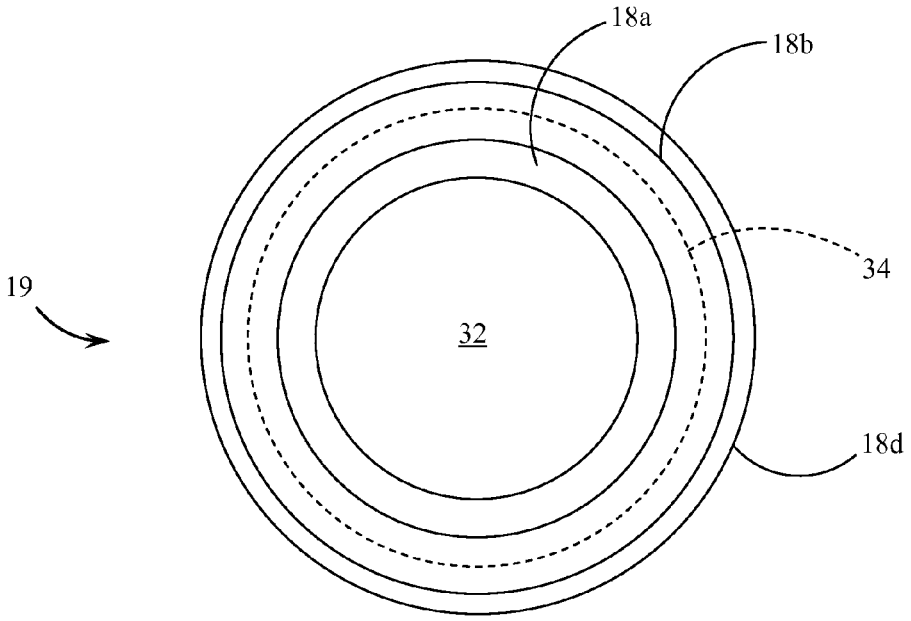
FIG. 4 is a top plan view of the plate stack of the present invention shown removed from the container body for clarity.

FIG. 4 is a top plan view of the plate stack of the present invention shown removed from the container body as a manner of clarifying the various diametrical sizes of the spacers and plates within the detector tube stack. In this view, ceramic spacers 18*a*, 18*b*, and 18*d* are shown. Plate stack 19 in this view is shown to comprise collector plate 32 (positioned on the top in this view), as well as detector plate (neutron sensitive material) 34 shown in dashed outline form as hidden in this particular orientation. The relative differences between the diameters of the various components in the detector tube stack shown are established primarily to allow for ready access to the necessary electrical contacts positioned on each of the spacer components, and to center the various operational plates within the detector tube stack. A given exposed area for each of the relevant functional plates (collector plate 32, detection plate 34, and electron generating plate 36) will vary according to the overall requirements of the detector. This cross-sectional functional diameter is best seen in FIG. 1B where internally each of the functional plates are oriented and positioned parallel and in proximity to one another to define a circular exposure area between them that in turn defines the functional characteristics of the detector tube, both in the manufacturing process and in its operation.

The novel concepts of the invention include the use of a scrub source (the electron generating plate) inside of the packaged device. This allows for a completely welded metal container that is very robust and simple to manufacture. The scrub source can be used as a signal generator after the device is sealed to test and calibrate the device. The use of the getter (the collector plate) allows for residual gas pumping after the device is sealed and burned in.

The method of manufacture is generally as follows. The components include: the scrub source plate; the neutron sensitive plate; and the anode plate. These components are arranged in a stack using metal rings for electrical contacts and ceramic spacers to insulate each component from one another. Ceramic spacers are also located at the top and bottom of the stack to insulate the metal can from the sensor stack up. Each component plate has appropriate electrical connections and is attached to a feed through conductor.

The assembly process is as follows. A quality check is made of all components. The stack up of components is assembled with the scrub source plate, the neutron plate, the anode plate, the metal contact rings, and the contact spacers, as shown in FIGS. 1A, 1B & 2. The above components are stacked up with the correct spacing and are placed into the base section of the metal container (can). The electrical connections are made and the cover is placed onto the can. The cover is welded (laser or TIG) in place with a hermetic quality weld. The pinch off tube is connected to a helium leak detector and the can is leak checked.

Figure 5A:
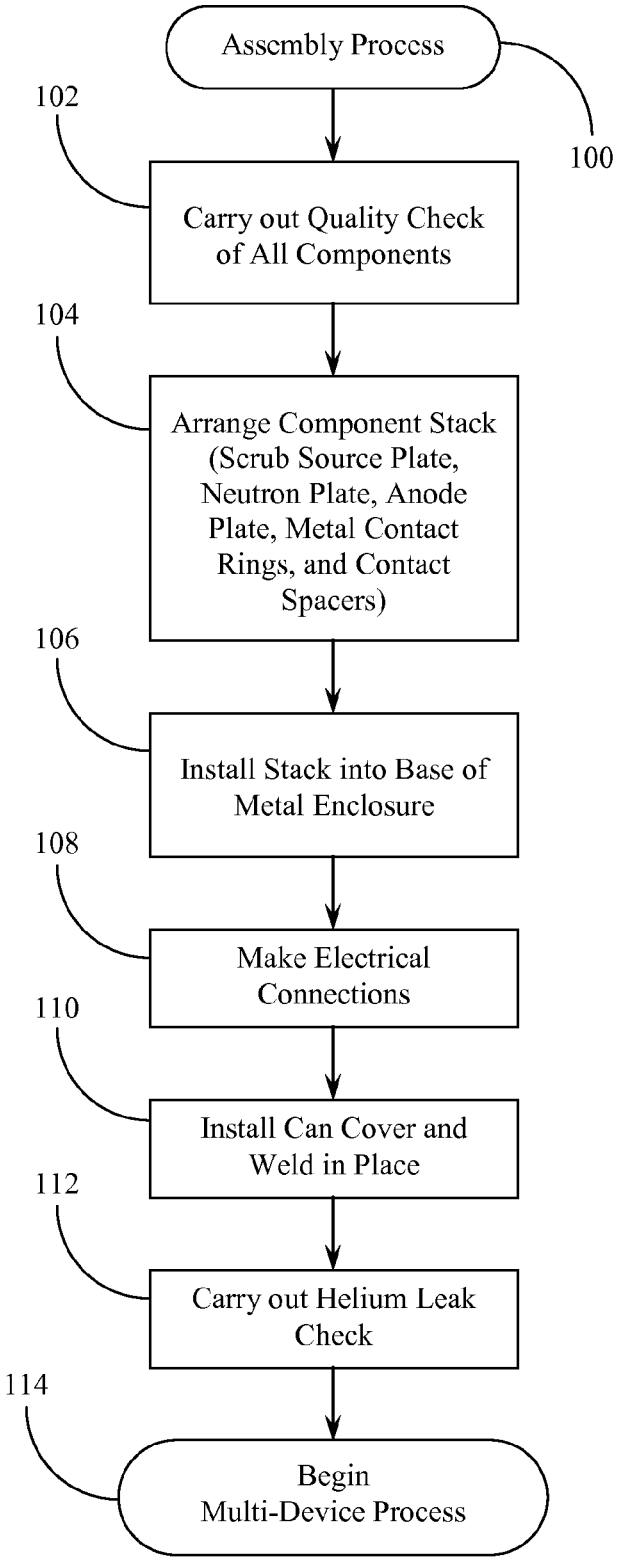
FIG. 5A is a flow chart describing the individual device assembly process of the method of the present invention.

Reference is next made to FIG. 5A for a further description of the individual device assembly process of the method of the present invention. Assembly process 100 begins at Step 102 whereby a quality check of all components to be assembled is carried out. This is followed at Step 104 by the arrangement of the component stack to include the scrub source plate, the neutron detection plate, the anode plate, as well as the various metal contact rings and the contact spacers described above. At Step 106 the arranged component stack is then installed into the base of the metal enclosure. Various electrical connections are made at Step 108. The can cover is positioned and welded in place at Step 110 and the helium leak check is performed at Step 112. The individual device assembly being completed, the process then proceeds to the multi-device process at Step 114.

The next part of the process may be carried out on a number of detector enclosures being produced at the same time. An array of containers may be configured on assembly trees and processed in steps as a group. An advantage of this tree system of processing is that it is scalable. That is, tree one may carry out loading; tree two may carry out pumping and bake out; tree three may carry out scrubbing; and tree four may carry out pinch off, sealing, and unloading.

The manufacturing process is scalable since trees can be added anywhere on the line. It is likely that there would be multiple trees scrubbing at the same time, for example. If each process took one day to complete (for example), then day five would begin the second loading of tree one and every day would yield finished product after that.

Figure 5B:
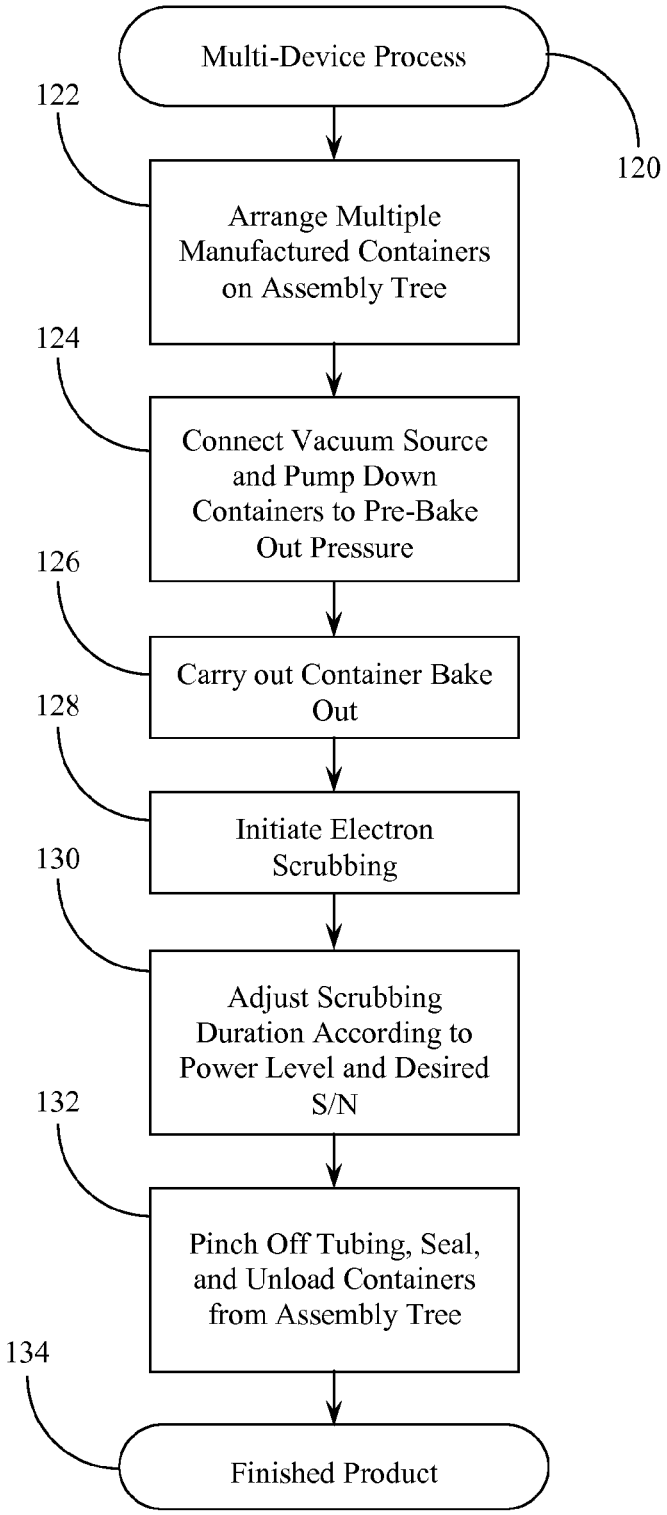
FIG. 5B is a flow chart describing the multi-device manufacturing process of the method of the present invention.

Reference is next made to FIG. 5B which is a flow chart describing the multi-device manufacturing process of the method of the present invention. Multi-device process 120 is initiated at Step 122 where multiple manufactured containers are arranged on an assembly tree as described above. At Step 124 a vacuum source is connected and pumps down the containers to a pre-bake out pressure. The method than proceeds at Step 126 to carry out the container bake out process before initiating electron scrubbing at Step 128. The duration of the scrubbing is adjusted according to power level and the desired signal to noise ratio for the detector at Step 130. The multi-device process then proceeds at Step 132 by pinching off the tubing components on each of the devices and then sealing and unloading the individual containers from the assembly tree. This results in the finished product at Step 134.

The manufacturing process is therefore highly efficient since there is less investment in assembly processing than with a hot or cold indium sealing process. Additionally, if the container/can fails a leak check, it can be re-worked and checked again many times. If the can is deemed unusable, it can be disassembled and the components can be re-used with little risk of damage. One key feature is that the sensor is packaged and sealed into the container/can before it is pumped. When the leak check is passed, the container/can is attached to a pumping station. A pumping station can accommodate a large quantity of containers/cans to be processed. The tree is then "pumped down" to a pre-bake out base pressure. An oven is placed around the loaded tree and the process is performed. When the bake is completed the scrubbing process can begin. Depending on the EV (power level of the scrub source), and required signal to noise ratio of the finished sensor, this scrubbing step in the process can take several days.

The various components in the assembly of the present invention may be constructed of various materials known in the art for such elements internally operational in a vacuum environment. The collector plate, for example, should be constructed of a conductive metal with an oxidation free surface that does not insulate against or resist the electrons that are generated by the internal workings of the detector. A nickel based material may be preferred, but polished aluminum or stainless steel may also be utilized for the material of the collector plate.

The basic concepts of the present invention may be implemented in conjunction with detector tube stacks that contain more than one electron generating plates and more than one neutron sensing micro channel plates (MCP). The multiple plates in each case would of course dictate additional electrical contacts in order to carry out the operation of each of the components either during the manufacturing process or during the operational process.

The typical exhaust port of the present invention may be constructed from copper vacuum tubing and may exit any surface of the detector, although the preferred embodiment places the same onto the rear end cap where each of the electrical penetrations are also made. The exhaust port may be directed straight out of the detector as shown in the figures, or may bend ninety degrees relative to the indicated attachment surfaces. Some flexibility with regard to the tubing is desired in order to allow multiple detectors to be variously stacked or arranged during processing in the multi-device manufacturing method described.

The relative dimensions and spacing in the detector tube stack (seen most accurately in FIG. 2) may also vary according to the specific characteristics required of the detector. In FIG. 2 the direction of particle detection is from the bottom of the page to the top, i.e., from the front of the detector to the rear. Formed end cap (front) 16 of the detector housing is a vacuum tight metal skin such as ⅛ inch to ¼ inch thick stainless steel or aluminum. Such thicknesses are necessary in order to prevent the vacuum within the detector from collapsing or crumpling the skin wall. The electron generating plate must be far enough away from this front face enclosure wall as to prevent any arcing. A preferred dimension ( ) may be 0.050 inches, or a distance in the range of 0.020 inches to 0.250 inches.

Electron generating plates are available in thicknesses similar to standard micro channel plates (MCP) such as 0.4 mm, 0.5 mm, or 1.0 mm thick. The spacing between the electron generating plate and the detection plate ( ) may be as small as 0.010 inches but is preferably in the range of 0.025 inches to 0.050 inches, again simply to avoid arcing between the plates. The thickness of the micro-channel plate (detector plate) may be a standard thickness, as described above ranging from 0.4 mm to 1.0 mm. Again these include commercially available products such as 0.4 mm, 0.5 mm, 0.6 mm, 0.8 mm, and 1.0 mm thick plates.

The spacing from the MCP to the detector output (collector plate) may be similar to the spacing between the remaining plates as described above. In the case that the detector output contact anode consists of a phosphor coated optic, a generally greater voltage is applied which requires increased spacing between the component and the formed end cap (rear) of the overall enclosure. This spacing may preferably be from 0.020 inches to 0.100 inches as higher voltages are usually used to accelerate detector signal electrons to surfaces requiring additional photonic output. The collector anode for the detector may be a thin sheet of metal as described above, such as 0.5 mm thickness.

Detectors, no matter how well they are pumped out in initial processing, are not immune to having less than all molecules or atoms of volatile species initially pumped out of the detector prior to the processing, or immune from bulk materials used to construct the detector that may outgas volatile species over the life of the detector. In either case gas may accumulate inside the detector after it has been sealed and a non-evaporable getter is normally positioned within the detector to sequester the molecules to the getter and remove them the operational internal surfaces of the detector plates. During the burn-in of a detector, a slow initial activation of the detector for the first time, care is taken to not electrically arc the internal components.

The various electrical contacts internal to the system (See FIG. 1B) will have wire conductors welded or soldered to them that provide the various isolated voltages at the detector contact surfaces. These electrical conductors are attached and soldered to the inner post of the electrical feed through during the assembly phase prior to attaching them. Welding and electrical testing is typically done by hand. The loaded detector enclosures are baked under vacuum to several hundred degrees centigrade (between 300 and 500 degrees centigrade). The electron scrubbing occurs after the manufacturing systems and detectors have substantially cooled down to between room temperature and 100 degrees centigrade.

Assembly trees of loaded detectors may run with global common voltages to the same functional feed-through conductors or each detector may have dedicated power supplies as necessary. The level of process control tends to be better with dedicated power supplies to each of the individual detector components. Voltages and currents are slowly ramped up during MCP activations (scrubbing of the MCP component) to normal detector voltages and currents. Additional quality checks are carried out during the manufacturing process. A clean pumped out detector is interfaced or connected to a helium leak detection system wherein a small partial pressure of helium is introduced to the outer surfaces of the detector and a leak checker senses for small levels of helium penetrating through or around the detector's seals or surfaces.

The present invention again provides for multi-detector assembly steps that exceed the typical loading levels and output rates of traditional detector vacuum processing systems. The present invention may in practice hold several times more detectors than traditional vacuum manufacturing systems (twelve versus fifty detectors on-line at a time per system). Although the preferred embodiment of the present invention comprises a round (cylindrical) package at a 40 mm diameter format, various other configurations are possible. 50 mm or 75 mm round formats may function in the same manner as described above. It is also possible for a square 50 mm by 50 mm format to operate at the same manufacturing structures and through the same manufacturing steps as described above. On balance, the manufacture of a round detector is more efficient than that of a square detector but certain applications may prefer square detectors in their final use and in assemblies with various components in which the detector functionality will be carried out.

Although the present invention (apparatus and methods) has been described in conjunction with a preferred embodiment, those skilled in the art will recognize alternate embodiments appropriate for use with different types of detectors and different manufacturing environments. The example provided relates primarily to a neutron detector although other types of particle and EM radiation detectors could also be manufactured using the principles of the present invention. In addition, the specific geometry (shape and size) shown for the detector stack is likely to vary depending on the particular application to which the detector is placed. In the example shown the basic neutron detector might use, for example, a 40 mm tube body with a welded anode; an 18 mm neutron detector MCP style plate; and an 18 mm electron generating plate. The adaptor rings would be designed and fabricated to fit the 18 mm and 40 mm components as required and provide electrical contact to the tube body connections. The desired front end spacing would be set by the spacer placements and thicknesses. The welds would engage the typical indium trough at the front end of the 40 mm tube body. The construction would include a sensor stack container that would completely envelope the 40 mm tube body when the lid is attached and would further include five high vacuum electrical feed throughs, a nickel pinch off tube with CF flange attachment for pumping system connection, upper and lower ceramic spacers to insulate and stabilize the tube body inside of the can, all of which will minimize overlaps and virtual leak paths.

The basic methodology which may be adapted (again to specific types of detectors and specific manufacturing environments) includes the steps of: arranging and constructing the stack (and surrounding components); leak checking (reworking as necessary); connecting; pumping; baking; scrubbing; testing (basic operational); pinching off; and final testing (particle source).

A further improvement to the manufacturing process may be achieved through the use of an ion pump that is maintained on the container/can. This would provide the added benefits of removing any gasses released during testing and/or burn in. The ion pump may also function as a vacuum gauge to quantify any noise or sensitivity data during testing. Component damage can be avoided if the vacuum pressure is monitored and is not too high.

We claim:

1. A detector tube assembly structured to permit electron scrubbing after the assembly has been enclosed and at least partially sealed, the detector tube assembly comprising:

(a) a walled container comprising side walls, a formed front end cap, and a formed rear end cap, the front end cap welded to the side walls along a perimeter edge of the front end cap and the rear end cap welded to the side walls along a perimeter edge of the rear end cap;

(b) an evacuation tube extending through and welded to the rear end cap, the evacuation tube in flow communication with an interior volume defined within the walled container;

(c) a plurality of stacked parallel plate elements positioned within the interior volume of the walled container, the plurality of stacked parallel plate elements separated from each other and from the front and rear end caps by a plurality of spacers, the plurality of stacked parallel plates comprising:

(i) a detector plate, the detector plate having a front surface and a rear surface;

(ii) an electron generating plate positioned in spaced arrangement between the detector plate and the front end cap, the electron generating plate having a front face oriented towards the detector plate and a rear face oriented towards the front end cap; and (iii) a collector plate positioned in spaced arrangement between the detector plate and the rear end cap; and (d) a plurality of electrical conductors extending from contact with the plurality of stacked parallel plate elements through the rear end cap;

wherein the detector plate may be activated and scrubbed by the electron generating plate as part of the manufacturing process, after the assembly has been enclosed and at least partially sealed, the final evacuation of the assembly occurring through the evacuation tube which is then pinched off to finally enclose and seal the assembly for operation.

2. A method for manufacturing a detector tube having an integrated electron scrub system, the method comprising the steps of:

(a) providing a walled container with side walls, a formed front end cap having an interior face, and a formed rear end cap having an interior face, the walled container defining an interior volume;

(b) providing an evacuation tube extending through the rear end cap and welding the evacuation tube to the rear end cap;

(c) arranging a stack of parallel plate elements and spacers within the interior volume of the walled container, the step of arranging the stack of plate elements and spacers comprising the steps of:

(i) positioning a first spacer against the interior face of the front end cap;

(ii) positioning an electron generating plate against the first spacer;

(iii) positioning a second spacer against the electron generating plate;

(iv) positioning a detector plate against the second spacer;

(v) positioning a third spacer against the detector plate;

(vi) positioning a collector plate against the third spacer; and (vii) positioning a fourth spacer between the collector plate and the interior face of the rear end cap;

(d) extending a plurality of electrical conductors from the electron generating plate, the detector plate, and the collector plate through the rear end cap;

(e) welding the front end cap and the rear end cap to the side walls of the walled container to form an at least partially sealed enclosure;

(f) performing a helium leak check on the at least partially sealed enclosure defined by the walled container;

(g) arranging a plurality of detector tube assemblies constructed according to steps (a) through (f) on an assembly tree;

(h) connecting a negative pressure source to the evacuation tube and pumping down the plurality of detector tube assemblies to a pre-bake out pressure;

(i) carrying out container bake out;

(j) initiating electron scrubbing of the detector plate by activating the electron generating plate by establishing a voltage across the electron generating plate;

(k) pinching off the evacuation tubing and sealing each of the plurality of detector tube assemblies; and (l) removing each of the plurality of detector tube assemblies from the assembly tree.

* * * * *